US006349191B1

(12) United States Patent
Willis

(10) Patent No.: US 6,349,191 B1
(45) Date of Patent: Feb. 19, 2002

(54) REPLACEABLE CONTAINER ASSEMBLY FOR STORING MATERIAL FOR DELIVERY TO OR FROM A PRINTING MACHINE

(75) Inventor: Keith L. Willis, Rochester, NY (US)

(73) Assignee: Xerox Corporation, Rochester, NY (US)

( * ) Notice: Subject to any disclaimer, the term of this patent is extended or adjusted under 35 U.S.C. 154(b) by 0 days.

(21) Appl. No.: 09/676,942

(22) Filed: Oct. 2, 2000

(51) Int. Cl.[7] ..... G03G 15/08

(52) U.S. Cl. ..... 399/262; 222/DIG. 1; 399/120; 399/258

(58) Field of Search ..... 222/DIG. 1; 399/120, 399/222, 252, 258, 262

(56) References Cited

U.S. PATENT DOCUMENTS 5,710,963 A * 1/1998 Dirx ..... 399/262

5,815,644 A * 9/1998 Nishiuwatoko et al. ..... 399/113

* cited by examiner

*Primary Examiner*—Sophia S. Chen
*Assistant Examiner*—Hoang Ngo
(74) *Attorney, Agent, or Firm*—Perman & Green, LLP

(57) ABSTRACT

A container assembly for storing material for delivery to or from a printing machine, the assembly including a container having a chamber for storing the material and a first mouth member, the container releasably co-operable with a conduit device having a second mouth member projecting therefrom and a screw-on mating mechanism positioned on the second mouth member, the container including a plurality of bump-like projections adapted to lift the mating mechanism so as to easily permit the container to be inserted into or removed from the machine and easily permit the first mouth member to be in contiguous relation to second mouth member, whereby the screw-on mating mechanism is adapted to screw onto the first mouth member and secure the container to the device permitting the material to flow between the container and the device.

23 Claims, 6 Drawing Sheets

REPLACEABLE CONTAINER ASSEMBLY FOR STORING MATERIAL FOR DELIVERY TO OR FROM A PRINTING MACHINE

BACKGROUND OF THE INVENTION

1. Field of the Invention

This invention relates generally to a customer replaceable unit (CRU) for a printing machine, and more particularly concerns a CRU container as typically used in an electrophotographic printing machine that can be easily and quickly replaced.

2. Description of the Prior Art

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are thereafter heated to permanently affix the powder image to the copy sheet.

In printing machines such as those described above, a CRU container is a customer replaceable unit which can be replaced by a customer. CRUs, particularly xerographic CRUs, typically include toner container (i.e. bottles), (e.g. waste toner or new toner), cleaner waste bottles or humidifier waste bottles. For purposes of ease of describing the present invention, the example will constantly be given of toner containers or bottles. However, it is to be understood that the present invention is a unique design for any CRU container or bottle as typically used in a printing machine such as a xerographic printer and therefore can include, toner bottles, cleaner solution bottles or any other CRU bottle used in such machines. In addition, the terms "containers" and "bottles" as used herein are equivalent to each other.

In the process of electrophotographic printing, the step of conveying toner to the latent image on the photoreceptor is known as "development". The object of effective development of a latent image on the photoreceptor is to convey developer material to the latent image at a controlled rate so that the developer material effectively adheres electrostatically to the charged areas on the latent image. A commonly used technique for development is the use of a two-component developer material, which comprises, in addition to the toner particles which are intended to adhere to the photoreceptor, a quantity of magnetic carrier granules or beads. The toner particles adhere triboelectrically to the relatively large carrier beads, which are typically made of steel. When the developer material is placed in a magnetic field, the carrier beads with the toner particles thereon form what is known as a magnetic brush, wherein the carrier beads form relatively long chains which resemble the fibers of a brush. This magnetic brush is typically created by means of a "developer roll".

Another known development technique involves a single-component developer, that is, a developer which consists entirely of toner. In a common type of single-component system, each toner particle has both an electrostatic charge (to enable the particles to adhere to the photoreceptor) and magnetic properties (to allow the particles to be magnetically conveyed to the photoreceptor). Instead of using magnetic carrier beads to form a magnetic brush, the magnetized toner particles are caused to adhere directly to a developer roll.

The present invention can be employed with either of the above known development techniques.

In an electrophotographic printer as the toner within the developer material is transferred to the photoreceptor and eventually to the copy paper, this used toner must be replaced. The electrophotographic printer thus includes a toner container (i.e. cartridge or bottle) from which fresh toner is dispensed into the machine. When using two component developer, a portion of the carrier granules will eventually deteriorate. Additional new carrier granules may be added to the machine to replace the deteriorated granules. The toner bottle may thus alternatively store a mixture including a small quantity of carrier granules in addition to the toner. To provide for a small compact toner bottle and to provide for a toner bottle which the opening to the bottle may be easily removed, the toner bottle typically has a compact shape with a small opening from which the toner is dispensed.

Traditionally when all the toner within a bottle has been consumed, additional toner is supplied to the machine by pouring toner from a separate refilling container into the bottle. This method permits many toner particles to become airborne during filling and enter the machine. The operator may even miss the opening of the container during filling and spill large quantities of toner inside the machine. Since the toner is inherently very susceptible to electrostatic charges, the toner sticks electrostatically to all the remote recesses of the machine making cleaning of the machine necessary. This cleaning process is both time consuming and expensive.

Xerographic machines have therefore been supplied with replaceable toner containers to avoid some of the problems associated with spilling toner during refilling. While missing the opening of the container during filling and spilling large quantities of toner is alleviated by replaceable toner containers, spillage can occur from the old container during removal and from new container installation.

Toner in the toner container must be fed to the latent image to effectuate development. Typically, toner containers are located with their openings in the bottom of the container whereby they may be emptied by gravity. In view of the general manner that these kinds of containers are used in xerographic printers it would represent a major advantage to have a CRU container that would generally reduce the number of steps required to disengage, remove and replace disposable containers with screw-on types of mating mechanisms positioned inside of the machine. Prior attempts to design toner and other containers for use in a xerographic printer such as an electrophotographic printer which offer these advantages and can function as a CRU in these kinds of environments have not generally be completely successful.

SUMMARY OF THE INVENTION

In accordance with one aspect of the present invention, there is provided a container assembly for storing material for delivery to or from a printing machine comprising a container having a chamber for storing the material and a first mouth member, the container releasably co-operable with a conduit device having a second mouth member projecting therefrom and a screw-on mating mechanism positioned on the second mouth member, the container including a plurality of bump-like projections adapted to lift the mating mechanism so as to easily permit the container to be inserted into or removed from the machine and also easily permit the first mouth member to be in contiguous relation to the second mouth member, whereby the screw-on mating mechanism is adapted to screw securely the container to the device permitting the material to flow between the container and the device.

Another aspect of the present invention provides a container assembly for storing a supply of particles for use in a developer unit of an electrophotographic printing machine comprising a container having both a chamber for storing the particles and a first mouth member, the container being releasably co-operable with a conduit device having a second mouth member projecting therefrom and a screw-on mating mechanism positioned on the second mouth member, the container including a plurality of bump-like projections adapted to lift the mating mechanism so as to easily permit the container to be inserted into or removed from the machine and easily permit the first mouth member to be in contiguous relation to the second mouth member, whereby the screw-on mating mechanism is adapted to screw onto the first mouth member and secure the container to the conduit device permitting the particles to flow between the container and the conduit device.

Another aspect of the present invention provides a developer unit for developing a latent image recorded on an image receiving member in a printing machine with a supply of particles, comprising a conduit device cooperable with a mechanism to feed the particles from a first mouth member on the device into the development unit, the conduit device including a screw-on mating mechanism adapted to screw onto the first mouth member; and a container defining a chamber for storing particles therein, the container having a second mouth member extending therefrom and a plurality of bump-like projections adapted to lift the mating mechanism so as to easily permit the container to be inserted into or removed from the machine and easily permit the second mouth member to be in contiguous relation to the first mouth member, the container adapted to be releasably cooperable with the device by fitting the first mouth member on the second mouth member and turning the mechanism to screw the mating mechanism onto both the first and the second mouth members whereby the container is firmly secured to the device.

Still another aspect of the present invention relates to an electrophotographic printing machine for developing with a supply of particles a latent image recorded on an image receiving member, the printing machine including a developer unit, the developer unit comprising a conduit device cooperable with a mechanism to feed the particles from a first mouth member on the device into the development unit, the device including a screw-on mating mechanism adapted to screw onto the first mouth member, and a container defining a chamber for storing particles therein, the container having a second mouth member extending therefrom and a plurality of bump-like projections adapted to lift the mating mechanism so as to easily permit the container to be inserted into or removed from the machine and permit the second mouth member to be in contiguous relation to the first mouth member, the container adapted to be releasably cooperable with the device by fitting the first mouth member over the second mouth member and screwing the mating mechanism onto the second mouth member whereby the container is firmly secured to the device.

Furthermore, another aspect of the present invention relates to a method for inserting and securing a container within a printing machine comprising the steps of inserting within the machine a container having a first mouth member and a plurality of bump-like projections, both the first mouth member and the projections extending from the top portion of the container; moving the first mouth member towards a conduit device in the machine, the device having a second mouth member projecting therefrom and a screw-on mating mechanism positioned on the second mouth member, the mating mechanism adapted to be in a screw fitting relation over the second mouth member; employing the bump-like projections to permit the second mouth member to remain in a position in the machine so as to allow the container to be pushed into the machine in a straight direction and position the first mouth member such that it is in contiguous relation to the second mouth member; and rotating the screw-on mating mechanism to screw onto both the first mouth member and the second mouth member thereby firmly securing the container to the device.

In accordance with the features of the present invention, there is described a customer replaceable unit (CRU) in the form of a cartridge container having a unique design that will reduce the total number of process steps that are required to disengage, remove and replace disposable containers with screw on mating mechanisms positioned inside of a printing machine. The unique design is for containers that pull out of the printing machine, but the screw-on mating mechanism which securely holds the container in the printing machine remains positioned inside of the printing machine.

In accordance with one preferred feature of the present invention, a container has been designed to have molded in bumps positioned on the exterior surface of the container to enable the action of pulling and/or pushing the container to cause the mating mechanism to lift over the mouth of the container thereby making it easier to place a container into or remove it from the printing machine, i.e. in a substantially straight direction.

In accordance with another preferred feature of the present invention, there is included a design for a finger actuated screw-on mating mechanism, i.e. the mechanism which tightens the grip onto the container so as to position the container within the machine to eliminate the need for a whole hand actuation of the mating mechanism inside the machine.

In accordance with still another preferred feature of the present invention, a screw-on mating mechanism is employed which is positioned and remains positioned within the printing machine.

BRIEF DESCRIPTION OF THE DRAWINGS

The invention will be described in detail herein with reference to the following figures in which like reference numerals denote like elements and wherein.

DETAILED DESCRIPTION OF THE PREFERRED EMBODIMENT

While the present invention will hereinafter be described in connection with a preferred embodiment thereof, it will be understood that it is not intended to limit the invention to that embodiment, On the contrary, it is intended to cover all alternatives, modifications, and equivalents, as may be included within the spirit and scope of the invention as defined by the appended claims.

For a general understanding of the features of the present invention, reference is made to the drawings. For a general understanding of some of the features of the present invention it is important to understand the type of environment that features in accordance with the present invention c an be used. In that regard it will become evident that the container assembly of the present invention is equally well suited to being used in a very large number of apparatus including, for example, reprographic printing machines, and it is not necessarily limited in its application to use in an electrophotographic printing machine as shown herein or described below or, in fact, even limited to use in a printing machine. The purpose of describing the various parts of an electrophotographic machine is simply to illustrate as an example that just about any container, cartridge or bottle as used in an electrophotographic machine as described below for containing a liquid or particulate solid material can employ the features of the present invention. In fact, by using as an example an electrophotographic printer as an apparatus that can employ the container assembly as defined by this invention there is no intent to limit the container assembly of this invention to this machine. Quite the opposite is true. The container assembly of the present invention can be used in just about any machine that employs containers, cartridges or bottles for storing a liquid or particulate solid material.

Figure 1:
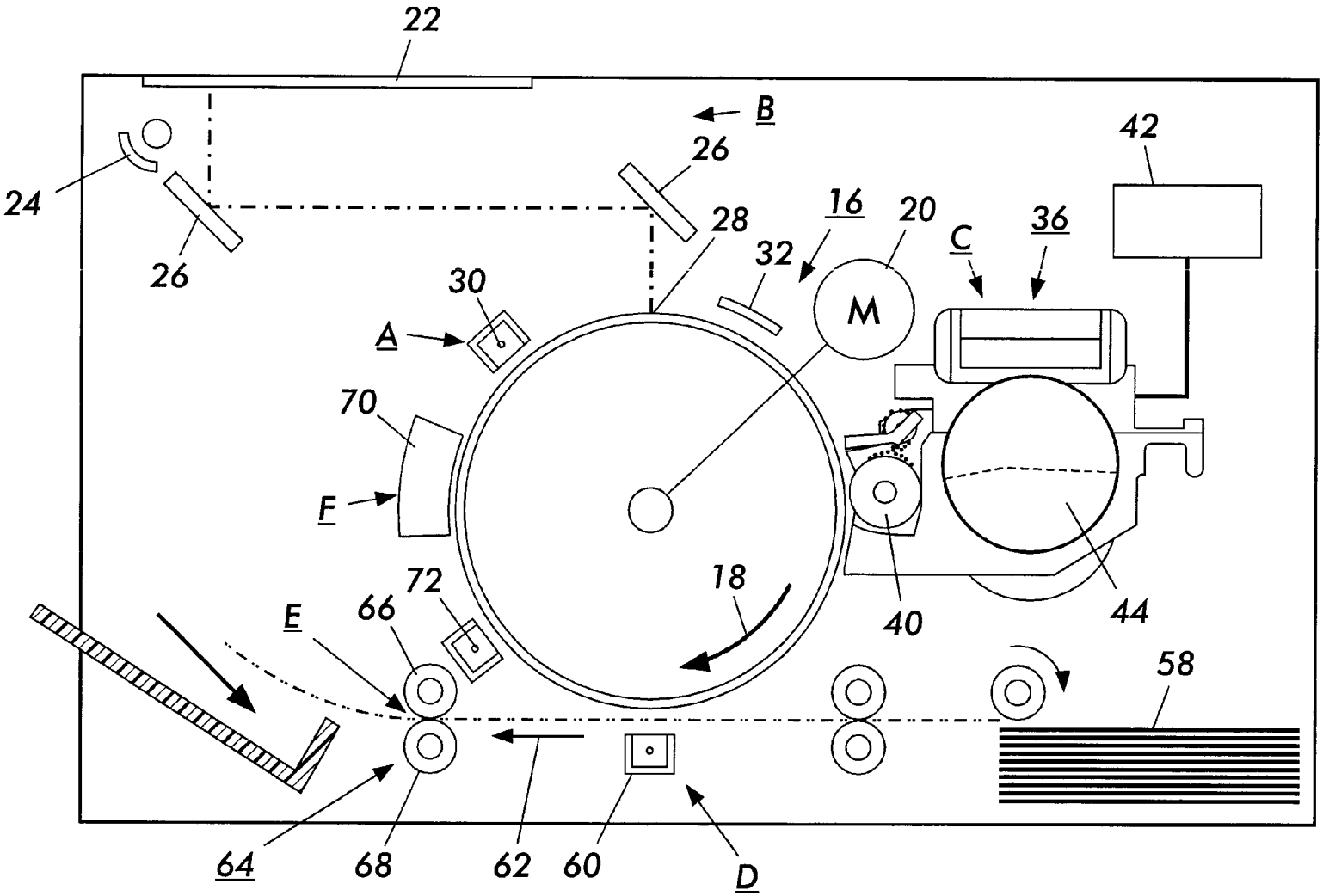
FIG. 1 is a schematic elevational view of an illustrative electrophotographic printing machine that can incorporate the features of the present invention.

Referring now to FIG. 1, the electrophotographic printing machine shown employs a photoconductive drum 16. Although photoreceptors in the form of a belt are also known, and may be substituted therefore. The drum 16 has a photoconductive surface deposited on a conductive substrate. Drum 16 moves in the direction of arrow 18 to advance successive portions thereof sequentially through the various processing stations disposed about the path of movement thereof. Motor 20 rotates drum 16 to advance drum 16 in the direction of arrow 18. Drum 16 is coupled to motor 20 by suitable means such as a drive.

Initially successive portions of drum 16 pass through charging station A. At charting station A, a corona generating device indicated generally by the reference number 30 charges the drum 16 to a selectively high uniform electrical potential, preferably negative. Any suitable control well known in the art, may be employed for controlling the corona generating device 30.

A document to be reproduced is placed on a platen 22, located at imaging station B where it is illuminated in a known manner by a light source such as a tungsten halogen lamp 24. The document thus exposed is imaged onto the drum 16 by a system of mirrors 26 as shown. The optical image selectively discharges surface 28 of the drum 16 in an image configuration whereby an electrostatic latent image 32 of the original document is recorded on the drum 16 at the imaging station B.

At development station C, a magnetic development system or unit indicated generally by the reference numeral 36 advances developer material into contact with the electrostatic latent images. Preferably, the magnetic developer unit includes a magnetic developer roll mounted in a housing. Thus, developer unit 36 contains a developer which advances toner particles into contact with the latent image. Appropriate developer biasing may be accomplished via power supply 42, electrically connected to developer unit 36.

The developer unit 36 develops the charged image areas on the photoconductive surface. This developer unit contains magnetic black toner, for example, particles 44 which are charged by the electrostatic field existing between the photoconductive surface and the electrically biased developer roll in the developer unit. Power supply 42 electrically biases the developer roll.

Figure 7:
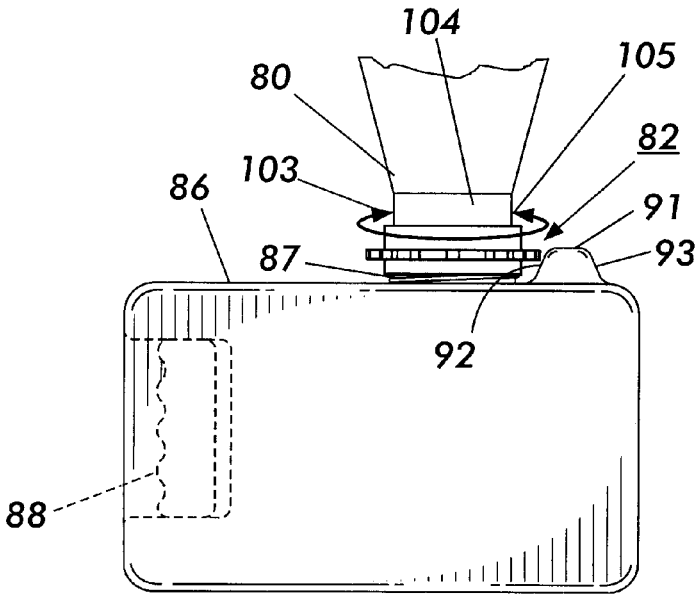
FIG. 7 is a front plan view of an embodiment of a container in position for either loosening from or tightening to a printing machine in accordance with the features of the present invention.
Figure 8A:
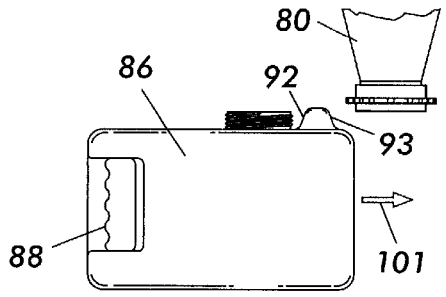
FIG. 8 (i.e. 8A, 8B, 8C and 8D) illustrates how an embodiment of a container is inserted within and secured to a printing machine in accordance with the features of the present invention.
Figure 8B:
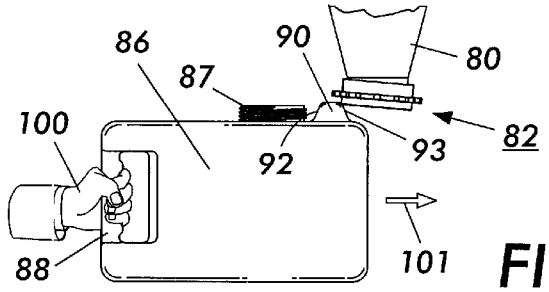
Figure 8C:
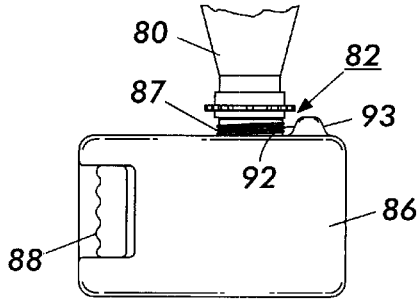
Figure 8D:
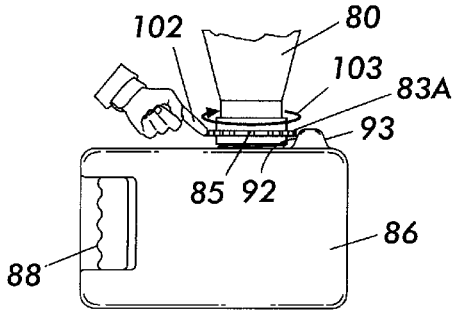
Figure 9A:
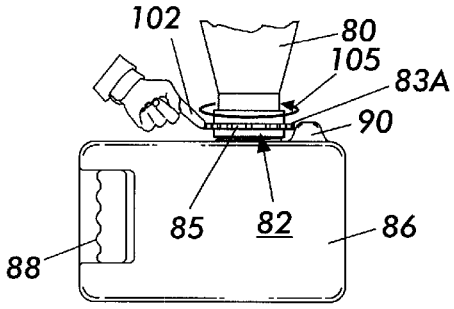
FIG. 9 (i.e. 9A, 9B, 9C and 9D) illustrates how an embodiment of a container is unsecured from a printing machine and removed therefrom in accordance with the features of the present invention.
Figure 9B:
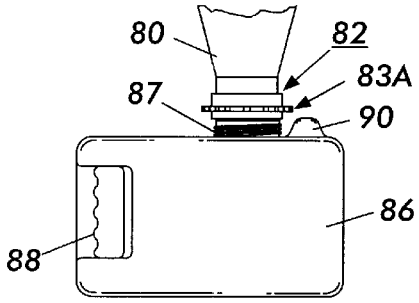
Figure 9C:
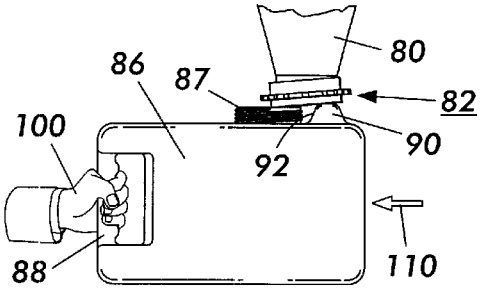
Figure 9D:
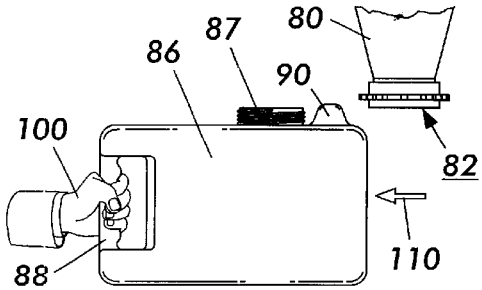

In accordance with the features of the present invention, the toner particles 44 can be fed to developer unit 36 from a container assembly as, for example, the container assembly illustrated in FIG. 7.

A sheet of support material 58 is moved into contact with the toner image at transfer station D. The sheet of support material is advanced to transfer station D by a suitable sheet feeding apparatus, not shown. Preferably, the sheet feeding apparatus includes a feed roll contacting the uppermost sheet of a stack of copy sheets. Feed rolls rotate so as to advance the uppermost sheet from the stack into a chute which directs the advancing sheet of support material into contact with the photoconductive surface of drum 16 in a timed sequence so that the toner powder image developed thereon contacts the advancing sheet of support material at transfer station D.

Transfer station D includes a corona generating device 60 which sprays ions of a suitable polarity onto the backside of sheet 58. This attracts the toner powder image from the drum 16 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64 which permanently affixes the transferred powder image to sheet 58. Preferably, fuser assembly 64 comprises a heated fuser roller 66 and a pressure roller 68. Sheet 58 passes between fuser roller 66 and pressure roller 68 with the toner powder image contacting fuser roller 66. In this manner, the toner powder image is permanently affixed to sheet 58. After fusing, a chute, not shown, guides the advancing sheet 58 to a catch tray also not shown for subsequent removal from the printing machine by the operator. It will also be understood that other post-fusing operations can be included, for example, stapling, binding, inverting and returning the sheet for duplexing and the like.

After the sheet of support material is separated from the photoconductive surface of drum 16, the residual toner particles carried by image and the non-image areas on the photoconductive surface are charged to a suitable polarity and level by a preclean charging device 72 to enable removal therefrom. These particles are removed at cleaning station F. The vacuum assisted, electrostatic, brush cleaner unit 70 is disposed at the cleaner station F. The cleaner unit includes two brush rolls that rotate at relatively high speeds which creates mechanical forces that tend to sweep the residual toner particles into an air stream (provided by a vacuum source) and then into a waste container. Subsequent to cleaning, a discharge lamp or corona generating device (not shown) dissipates any residual electrostatic charge remaining prior to the charging thereof for the next successive imaging cycle.

The various machine functions are regulated by a controller. The controller is preferably a programmable microproccesor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the documents and the copy sheets. In addition, the controller regulates the various positions of the gates depending upon the mode of operation selected.

It is believed that the foregoing description is sufficient for purposes of the present application to illustrate the general operation of an electrophotographic printing machine that can incorporate the features of the present invention therein.

Figure 2:
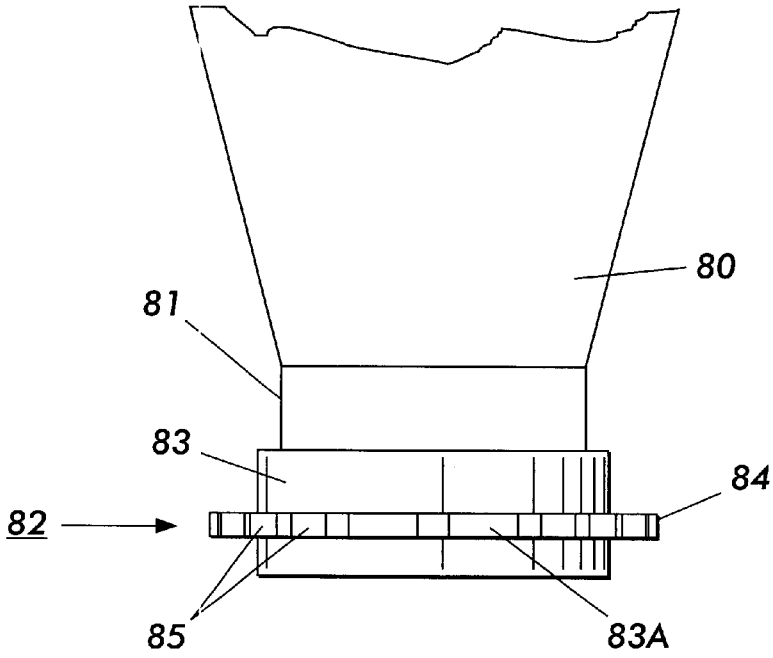
FIG. 2 is a front plan view of an embodiment of a conduit device having a mouth member and screw-on mating mechanism in accordance with the features of the present invention.
Figure 3:
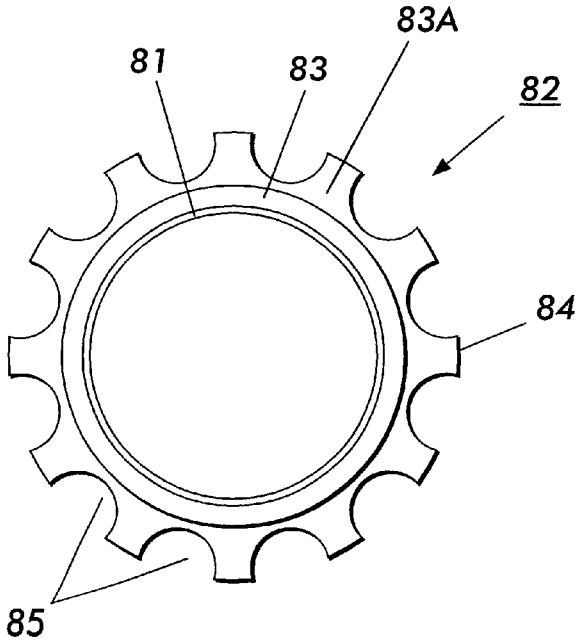
FIG. 3 is a top plan view of an embodiment of a screw-on mating mechanism in accordance with the features of the present invention.

As illustrated in FIGS. 2 and 3, there is shown those portions of a container assembly in accordance with the features of the present invention which resides securely within the printing machine which employs the features of the present invention. Specifically, there is shown a conduit 80 device which permits either liquid or particulate solid material (e.g. new toner or waste toner) to flow either from the electrophotographic copier to a container (not shown) or from a container to the electrophotographic copier. The conduit device 80 includes a mouth member 81 which extends from the one end portion of the conduit device 80. Mouth member 81 is threaded on its outer surface so as to permit a mating mechanism 82 to be screw-fitted thereon in such a manner as described hereinbelow. The screw-type member or mating mechanism 82 includes a first outer ring member 83 in screw-on relation around the outer circumference of mouth member 81. A second outer ring member 83A surrounds the circumference of first outer ring member 83, is firmly secured to member 83 and comprises a plurality of projections 84 extending outwardly from the circumference of outer ring member 83A along with a plurality of U-shaped openings 85 positioned between each pair of projections 84. This configuration enables a user of the electrophotographic machine to turn screw-on mating mechanism 83 simply by placing a finger into one of the U-shaped openings 85 and turning in either direction thereby either raising the screw-on mating mechanism 82 to the top portion of mouth 81 or lowering mechanism 82 so that it screws onto both mouth member 81 of device 80 and mouth member 87 of container 86 (see FIGS. 4 and 5).

Figure 4:
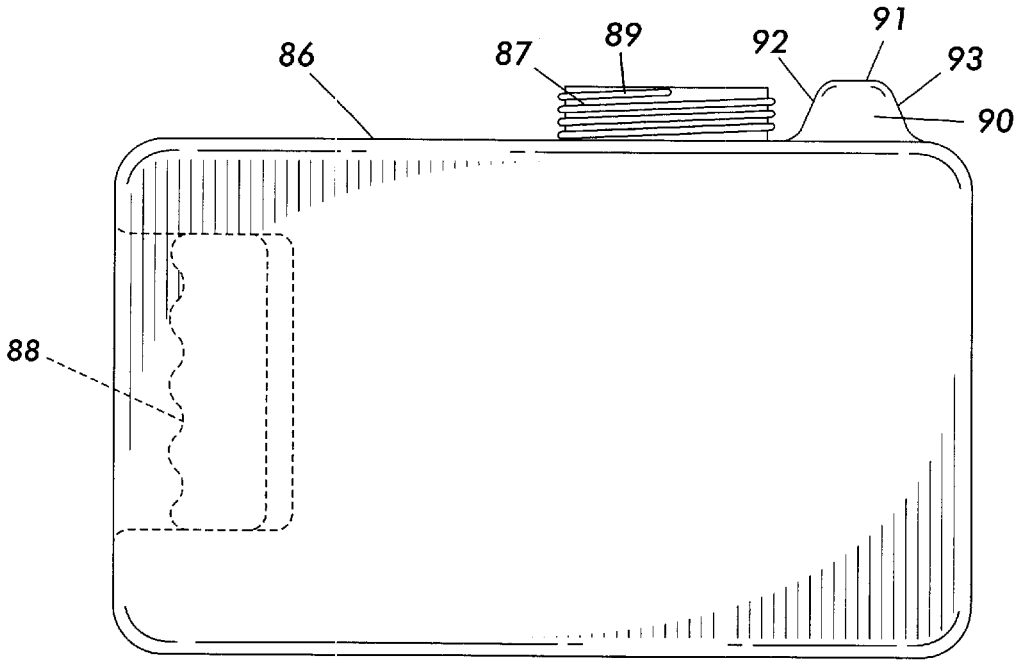
FIG. 4 is a front plan view of an embodiment of a container in accordance with the features of the present invention.
Figure 5:
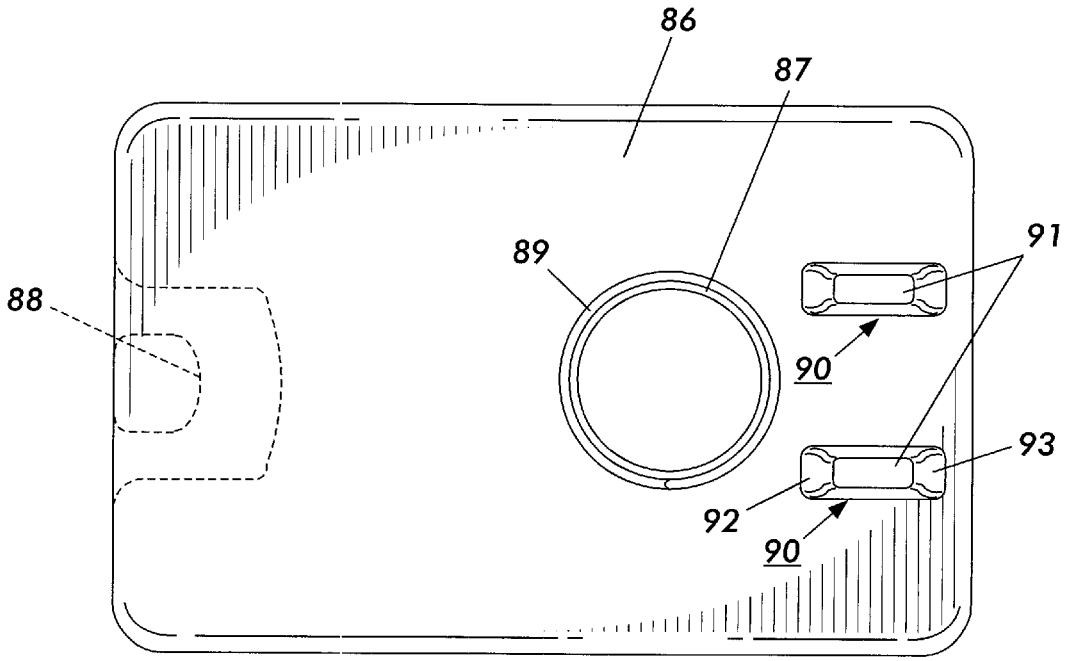
FIG. 5 is a top plan view of the container illustrated in FIG. 4.

There is illustrated in FIGS. 4 and 5 an embodiment of a container 86 that can be employed with the container assembly in accordance with the features of the present invention. Specifically, there is shown container 86 which is secured (as explained in detail hereinbelow) to conduit device 80 (FIG. 2) so that material in container 86 can flow from the container to the electrophotographic machine (e.g. new toner), or flow from the electrophotographic machine to the container (e.g. toner waste). Container 86 includes a mouth member 87 projecting from the top portion of the container. The mouth member 87 is preferably threaded 89 to allow for it to be screwed onto the screw-on mating mechanism 82 (see FIGS. 2 and 3) in the manner as explained herein below. Container 86 also includes a handle member 88 designed to allow a user to firmly grasp the container with one hand, and push the container into a printing machine or pull it out of such a machine. Included on the top portion of container 86 are a plurality of bump-like projections 90 which are preferably molded as one piece along with container 86 preferably of any well known plastic or plastic-like material well known for molding such containers. Each bump-like projection 90 (two are shown as an example) preferably comprises a flat top surface 91 and two sloping surfaces 92 and 93 This preferred shape for the bump-like projections will enable the projections to function such that the action of pulling and/or pushing the container 86 into or out from the printing machine will cause the mating mechanism 82 to lift over the mouth member 87 of container 86. See FIGS. 6 and 7 and the explanation hereinbelow.

Figure 6:
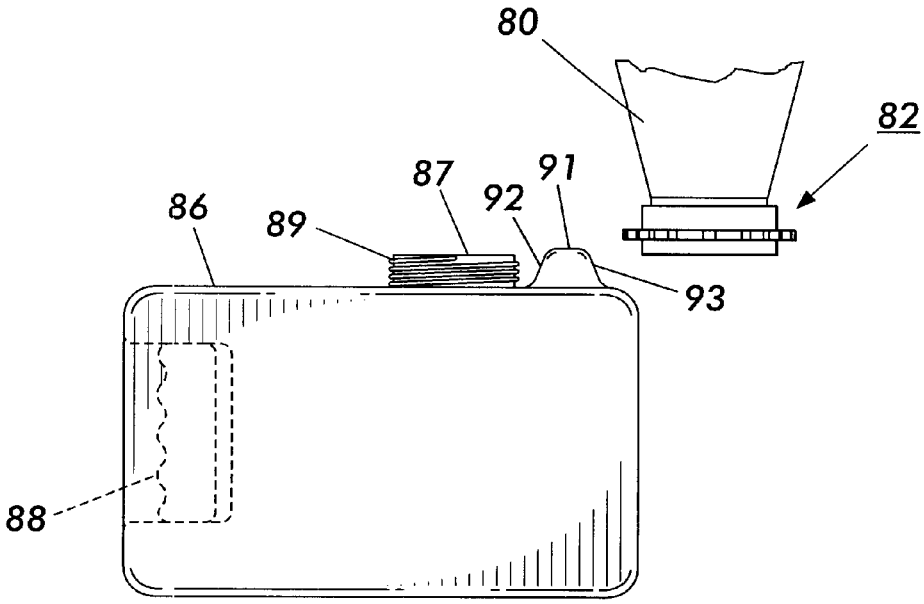
FIG. 6 is a front plan view of an embodiment of a container prior to it being secured to a conduit device in accordance with the features of the present invention.

FIG. 6 illustrates an embodiment of a container assembly in accordance with the features of the present invention either before container 86 is secured to conduit device 80 or after container 86 is unsecured from conduit device 80. Assuming, for example, that container 86 as illustrated in FIG. 6 is a toner bottle filled with particulate toner particles ready for use in an electrophotographic printer in the manner as described hereinabove and that the toner container 86 is to be securely inserted and positioned within such a printer so that the toner can be properly distributed to the printer for development of an image.

As illustrated in FIG. 8 (i.e., FIGS. 8A, 8B, 8C and 8D) container 86 is to be inserted within a printing machine and secured to conduit device 80 which is positioned within the machine as specifically shown in FIG. 7. To start the process of securing a toner bottle within a electrophotographic printer, the hand of a user 100 grabs the handle 88 on the toner container and pushes the toner container in a straight direction of arrow 101 towards conduit device 80 (FIG. 8A). In accordance with the features of the present invention the container 86 is designed with molded in-bump type projections 90 and a treaded mouth member 87. As the user pushes the container 86 in the direction of arrow 101 (see FIG. 8B) the bump type projections 90 will cause (i.e. due to inclined surfaces 92 and 93 on each of the bumps) the internally positioned mating mechanism 82 to lift over to the mouth member 87 of container 86 so as to be ready to be screwed onto mouth member 87 (see FIG. 8C). Thereafter, and as shown in FIG. 8D and also FIG. 7, a user's finger 102 is employed to turn outer ring member 83A by positioning the finger 102 in one of the U-shaped openings 85 of outer ring member 83A and turning the outer ring member 83A in the direction of arrow 103 until the mating mechanism is screwed onto both the mouth member 87 of container 86 and the mouth member 104 projecting from conduit 80, thereby is firmly securing container 86 to conduit 80 such that the particulate toner within container 86 will be correctly distributed to the electrophotographic machine.

Once the particulate toner has been used up, and container 86 is basically empty and needs replacement, FIG. 9 (FIGS. 9A, 9B, 9C and 9D) and FIG. 7 illustrate how container 86 can be removed from the electrophotographic machine easier and faster than that previously required to accomplish this task. Specifically, as shown in FIG. 9 to remove container 86 from the electrophotographic machine, one starts by focusing on that shown in FIG. 9A and FIG. 7. Specifically, a user employs his or her finger 102 to turn outer ring member 83A in the direction of arrow 105 by positioning the finger 102 in one of the U-shaped openings 85 of outer ring member 83A, and then turning in the direction of arrow 105 until the mating mechanism 82 is unscrewed from the mouth member 87 located on the S container 86 (see FIG. 9B). As specifically illustrated in FIG. 9C a user's hand then grabs the handle 88 on the toner container 86 and pulls the container 86 in the straight direction of arrow 110, i.e. pulls in a substantially straight direction towards outside of the electrophotographic machine. In doing so in accordance with the features of the present invention, the action of pulling the container 86 in the direction of arrow 110 causes the mating mechanism 82 which has now been unscrewed from the mouth member 87 of container 86 to lift over the mouth 87 of the container 86 due to bumps 90. Once the container is continued to be removed out from the electrophotographic machine (see FIG. 9D), the screw-on mating mechanism remains in the electrophotographic machine secured in a screw on relation to conduit member 80 ready for attachment to a new container in the manner as described above.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A replaceable container assembly for storing material for delivery to or from a printing machine comprising a container having a chamber for storing the material and a first mouth member, the container releasably cooperable with a conduit device having a second mouth member projecting therefrom and a finger actuated screw-on mating mechanism positioned on the second mouth member, the container including a plurality of bump-like projections adapted to lift the mating mechanism so as to easily permit the container to be inserted into or removed from the machine and easily permit the first mouth member to be contiguous relation to the second mouth member, whereby the screw-on mating mechanism is adapted to screw onto the first mouth member and secure the container to the device permitting the material to flow between the container and the device.

2. A replaceable container assembly in accordance with claim 1 wherein both said device and said mating mechanism are positioned and secured to said machine.

3. A replaceable container assembly in accordance with claim 1 wherein said screw-on mating mechanism is circular in shape having a plurality of projections extending outwardly around its outer circumference along with a plurality of U-shaped openings positioned between each pair of said projections.

4. A replaceable container assembly in accordance with claim 3 wherein each U-shaped opening is adapted to receive a finger therein.

5. A replaceable container assembly in accordance with claim 1 wherein said container includes a handle member adapted to allow a user to remove said container from said machine or insert said container into said machine with one hand.

6. A replaceable container assembly in accordance with claim 1 wherein said machine is a xerographic printer.

7. A replaceable container assembly in accordance with claim 6 wherein said material is a toner.

8. A replaceable container assembly in accordance with claim 6 wherein said material is a liquid or a particulate solid.

9. A replaceable container assembly in accordance with claim 1 wherein said bump are molded together with said container.

10. A replaceable container assembly for storing a supply of particles for use in a developer unit of an electrophotographic printing machine comprising a container having a chamber for storing the particles and a first mouth member, the container being releasably cooperable with a conduit device having a second mouth member projecting therefrom and a finger actuated screw-on mating mechanism positioned on the second mouth member, the container including a plurality of bump-like projections adapted to lift the mating mechanism so as to easily permit the container to be inserted into or removed from the machine and easily permit the first mouth member to be in contiguous relation to the second mouth member, whereby, the screw-on mating mechanism is adapted screw onto the first mouth member and secure the container to the device permitting the particles to flow between the container and the device.

11. A replaceable container assembly in accordance with claim 10 wherein said mating mechanism is adapted to tightly position said second member over said first mouth member.

12. A replaceable container assembly in accordance with claim 10 wherein said particles are toner particles.

13. A replaceable container assembly in accordance with claim 10 wherein both said device and said mating mechanism are positioned and secured to said machine.

14. A developer unit for developing a latent image recorded on an image receiving member with a supply of particles, comprising a conduit device cooperable with a mechanism to feed the particles from a first mouth member on the device into the development unit, said device including a screw-on mating mechanism adapted to screw onto said first mouth member, and a container defining a chamber for storing particles therein, said container having a second mouth member extending therefrom and a plurality of bump-like projections adapted to lift said mating mechanism so as to easily permit said container to be inserted into or removed from said machine and easily permit said second mouth member to be in contiguous relation to said first mouth member, said container adapted to be releasably cooperable with said device by fitting said first mouth member over said second mouth member and turning said mechanism to screw said mating mechanism onto both said first and second mouth members whereby said container is firmly secured to said device.

15. A developer unit in accordance with claim 14 wherein said particles are toner particles.

16. A replaceable developer unit in accordance with claim 14 wherein both said device and said mating mechanism are positioned and secured to said machine.

17. A replaceable developer unit in accordance with claim 14 wherein said mating mechanism is a finger actuated screw-on mating mechanism, said screw-on mating mechanism being circular in shape and having a plurality of projections extending outwardly around its outer circumference along with a plurality of U-shaped openings positioned between each pair of said projections.

18. An electrophotographic printing machine for developing with a supply of particles a latent image recorded on an image receiving member, said printing machine including a replaceable developer unit, the replaceable developer unit comprising a conduit device cooperable with a mechanism to feed the particles from a first mouth member on the device into the replaceable development unit, the device including a finger actuated screw-on mating mechanism adapted to screw onto said first mouth member, and a container defining a chamber for storing particles therein, the container having a second mouth member extending therefrom and a plurality of bump-like projections adapted to lift the mating mechanism so as to easily permit the container to be inserted into or removed from the machine and easily permit the second mouth member to be in contiguous relation to the first mouth member, the container adapted to be releasably cooperable with the device by fitting the first mouth member over the second mouth member and screwing the mating mechanism onto the second mouth member whereby the container is firmly secured to the device.

19. A replaceable container assembly in accordance with claim 1 wherein said finger actuated screw-on mating mechanism is circular in shape and has a plurality of projections extending outwardly around its outer circumference along with a plurality of U-shaped openings positioned between each pair of said projections.

20. A method for inserting and securing a container within a printing machine comprising the steps of:

inserting within said machine a container having a first mouth member and a plurality of bump-like projections, both said first mouth member and said projections extending from the top portion of said container;

moving said first mouth member towards a conduit device in said machine, said device having a second mouth member projecting therefrom and a screw-on mating mechanism positioned on said second mouth member, said mating mechanism adapted to be in a screw fitting relation over said second mouth member;

employing said bump-like projections to permit said second mouth member to lift over said first mouth member so as to allow said container to be pushed into said machine in a straight direction and position said first mouth member such that it is in contiguous relation to screw said second mouth member; and rotating said screw-on mating mechanism to screw onto both said first mouth member and said second mouth member thereby firmly securing said container to said device.

21. A method in accordance with claim 20 further comprising the steps of:

rotating said screw-on mating mechanism to loosen said first mouth member from said second mouth member;

continuing to rotate said screw-on mating mechanism until it reaches the top portion of said second mouth member;

moving said container in a straight direction out from said machine and employing said bump-like projections to permit said second mouth member to remain in a position in said machine so as to allow said container to be moved out from said machine in a straight direction; and removing said container from said machine.

22. A method in accordance with claim 20 wherein said container is pushed into or removed from said machine by one hand.

23. A method in accordance with claim 20 wherein said screw-on mating mechanism is tightened or loosened by a finger.

* * * * *